US005813486A

United States Patent [19]

Smith et al.

[11] Patent Number: 5,813,486

[45] Date of Patent: Sep. 29, 1998

[54] D-RING ANCHORAGE CONNECTOR

[75] Inventors: Keith A. Smith, Burlington; Steve B. Levay, Font Hill; Bob Claus, Welland, all of Canada

[73] Assignee: Haun Drop Forge Co., Ltd., Ontario, Canada

[21] Appl. No.: 714,579

[22] Filed: Sep. 16, 1996

[51] Int. Cl.[6] ..... A47L 3/04

[52] U.S. Cl. ..... 182/3; 182/82; 248/231.91

[58] Field of Search ..... 182/3, 4, 82, 90, 182/100; 248/231.91

[56] References Cited

U.S. PATENT DOCUMENTS

| | | | |
|---|---|---|---|
| 471,626 | 3/1892 | Streeter | 182/90 |
| 490,362 | 1/1893 | Rich | 182/90 |
| 936,006 | 10/1909 | Matzner | 182/4 |
| 3,294,196 | 12/1966 | Rabelos | 182/100 |
| 4,515,244 | 5/1985 | Kramer | 182/100 X |
| 5,156,233 | 10/1992 | Olsen et al. | 182/3 |
| 5,287,944 | 2/1994 | Woodyard | 182/3 |
| 5,544,717 | 8/1996 | White et al. | 182/90 |

FOREIGN PATENT DOCUMENTS

| | | | |
|---|---|---|---|
| 2167954 | 6/1986 | United Kingdom | 182/100 |

*Primary Examiner*—Daniel P. Stodola
*Assistant Examiner*—Richard M. Smith
*Attorney, Agent, or Firm*—Merek & Voorhees

[57] ABSTRACT

An anchorage connector is comprised generally of an attachment device, a base plate and a generally arched shaped anchoring ring. The attachment device secures the connector to the surface of an object. The base plate is connected to the attachment device and helps to distribute forces to which the connector is subjected, across the surface of an object when the connector is secured to the object by the attachment device. The generally arched shaped anchoring ring has its upper end attached to the upper portion of the base plate and its lower end attached to the lower portion of the base plate such that the anchoring ring is positioned approximately perpendicular to the base plate. The width of the anchoring ring when viewed in a plane parallel to the base plate is greater at its upper and lower ends than at its apex such that the width of the ring is tapered towards its apex to encourage and direct the movement of a hook latched around the anchoring ring toward its apex when the ring is horizontally oriented, or toward the lower end of the anchoring ring when the anchoring ring is vertically oriented.

9 Claims, 3 Drawing Sheets

D-RING ANCHORAGE CONNECTOR

FIELD OF THE INVENTION

This invention relates to anchorage connectors of the type commonly attached to buildings, towers, bridges or other structures for the purpose of securing lifelines, safety harnesses or fall arrestors.

BACKGROUND OF THE INVENTION

When working at heights above a few feet from the grounds of primary importance is the employment of a safety system to prevent falls. Falling from a height of merely a few feet can result in serious injury or death. The need for such a safety system is greatest for workers on bridges, towers or tall buildings as falls in those cases are most likely to be fatal. For this reason numerous types of fall arresting or safety systems have been developed to help prevent falls or to provide a means by which a worker may secure himself to a structure.

While such devices may take many shapes and forms, the majority rely upon the utilization of a lifeline, safety harness or fall arrestor. These items typically comprise a rope or cable with one end attached in some fashion to a worker's body through the use of a belt or harness and the other end attached to the structure upon which the individual is working. In theory, in the event of a slip or loss of balance the lifeline or safety harness will allow the worker to fall only a very few feet after which the worker's decent will be stopped and he will be suspended until he can regain his balance or be rescued. However, in practise the dynamic forces created during a fall often prevent such prior art devices from working properly or present stresses that exceed their working capacity resulting in failure and injury or death. For example, probably the most common form of fall arresting device comprises a simple eye bolt that is attached to a building, bridge, tower or other structure. Typically a worker attaches a lifeline to the eye bolt through the use of a locking snap hook. The inherent limitations of this structure stem from the tendency of eye bolts to fail when subjected to dynamic or torsional loading, such as often occurs during a fall. A further limitation is a result of the tendency of snap hooks to sometimes become oriented across the diameter of the eye bolt such that in the case of a fall dynamic loading is applied directly to the hooks' keeper mechanism resulting in failure of the hook and possibly dislodgement from the eye bolt.

SUMMARY OF THE INVENTION

The invention therefore provides an anchorage connector that is able to fully withstand the considerable torsional loading and stress to which it may be subjected during a fall situation and also one which prevents the dynamic loading of the keeper mechanism of a locking snap hook. The invention also provides in combination such an anchorage connector together with a locking snap hook which prevents dynamic loading of its keeper mechanism.

Accordingly, in one of its aspects the invention provides an anchorage connector comprising: (i) attachment means to secure said connector to the surface of an object; (ii) a base plate connected to said attachment means, said base plate providing a means to distribute forces to which said connector is subjected across the surface of an object when said connector is secured to the object by said attachment means; and, (iii) a generally arched shaped anchoring ring having its upper end attached to the upper portion of said base plate and its lower end attached to the lower portion of said base plate such that said anchoring ring is positioned approximately perpendicular to said base plate, the width of said anchoring ring when viewed in a plane parallel to said base plate being greater at its upper and lower ends than at its apex such that said width of said ring is tapered towards said apex to encourage and direct the movement of a hook latched around said anchoring ring toward said apex when said ring is horizontally oriented or toward said lower end of said anchoring ring when said anchoring ring is vertically oriented.

In a further aspect the invention provides an anchorage connector in combination with a locking snap hook, said snap hook comprising: a central shank ending in an arched shaped hook member that has a free end defining a gateway opening between said hook member and said shank; and, a gate keeper rotationally mounted on said shank at a pivot point and pivotally engaging said free end of said arched shaped hook member to enclose said gateway opening, such that when said locking snap hook is received around the anchoring ring of the connector the loading of said snap hook results in a transference of said load to said anchoring ring through said shank and said hook member only without subjecting said gate keeper to dynamic or other loading forces.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
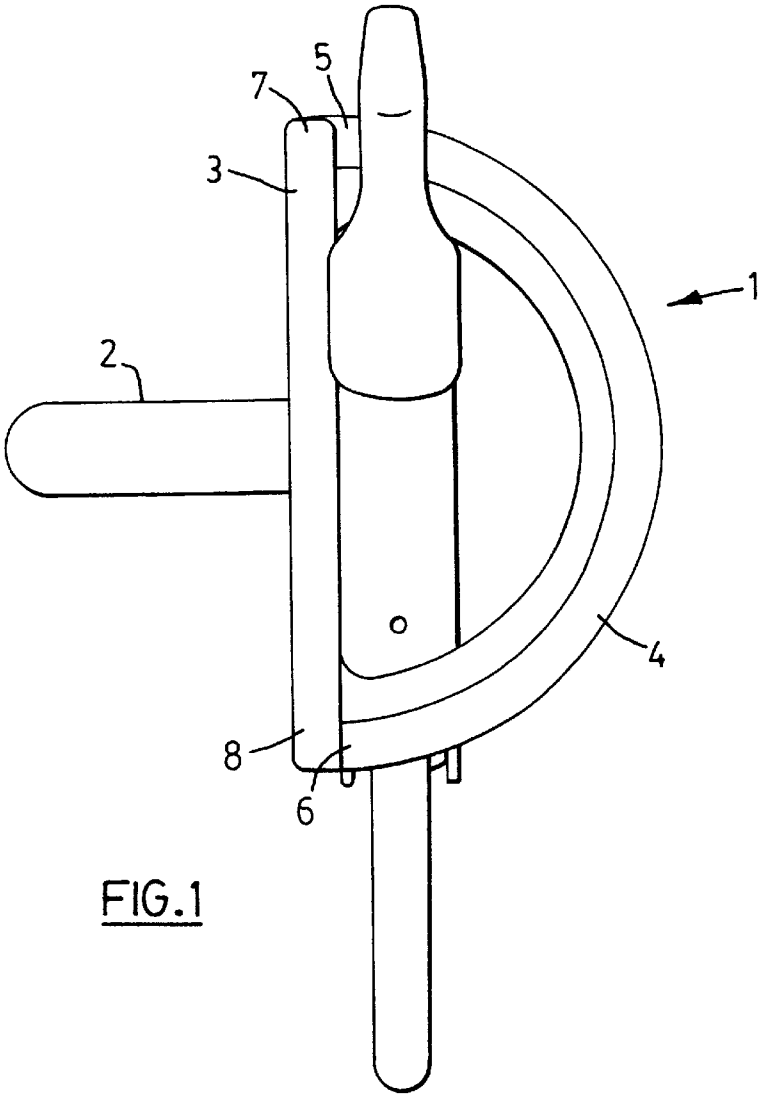
FIG. 1 is a side view of the anchorage connector of the present invention with a locking snap hook received thereon.
Figure 3:
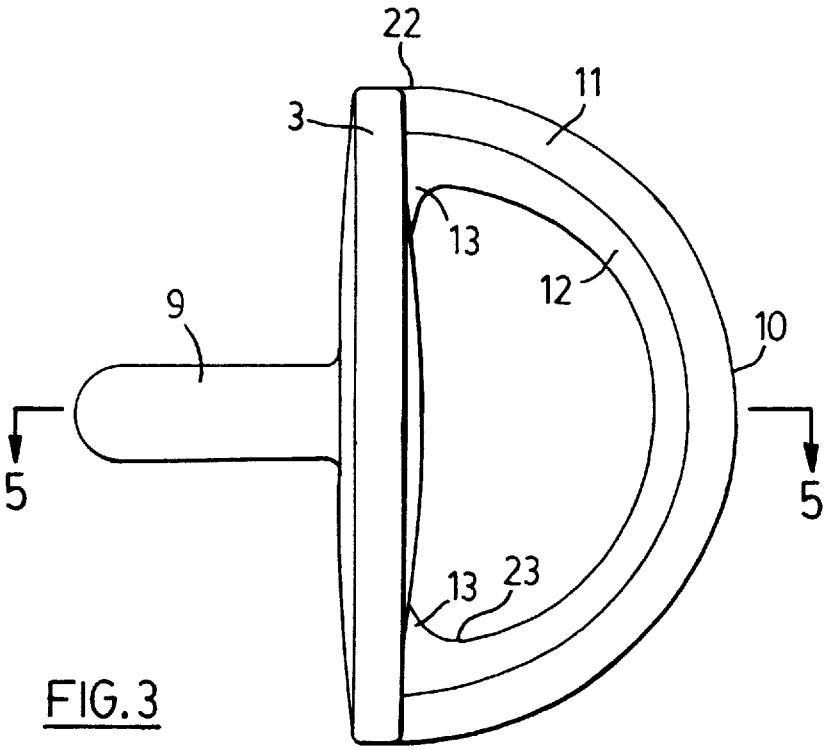
FIG. 3 is a side view of the anchorage connector of the present invention.

The anchorage connector of the present invention is identified in the attached drawings generally by the reference numeral 1. Connector 1 is comprised primarily of attachment means 2, a base plate 3 and an arched shaped anchoring ring 4. As shown in FIGS. 1 and 3, attachment means 2 extends outwardly from base plate 3 to provide a means to secure connector 1 to the surface of an object. Typically, connector 1 would be secured to the side of a bridge, building, tower, or other structure that requires the use of a safety line or harness to prevent a fall.

Figure 4:
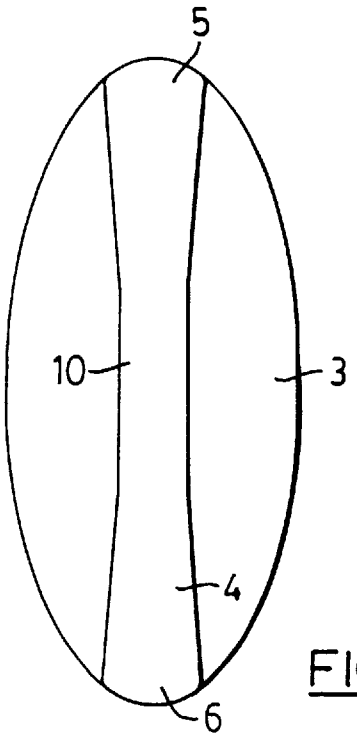
FIG. 4 is a plan view of the connector of FIG. 3.

Referring to FIGS. 3 and 4, It will be appreciated that base plate 3 is of a sufficient size so as to provide a means to distribute force to which connector 1 may be subjected across the surface of the object to which the connector is secured by attachment means 2. In its preferred orientation, connector 1 is situated with anchor ring 4 in a generally vertical plane. Anchoring ring 4 has an upper end 5 and a lower end 6 attached to upper and lower portions, 7 and 8 respectively, of base plate 3 such that anchoring ring 4 will extend outwardly from base plate 3 at approximately 90 degrees. In this way when connector 1 is attached to the surface of an object or structure anchoring ring 3 will be generally perpendicular to the structure's surface. It will thus be appreciated that base plate 3 will also extend generally vertically against the side of the structure to which connector 1 is attached. Accordingly, in the preferred orientation with connector 1 attached to a structure and base plate 3 held tightly and securely against the structure's surface, the loading of connector 1 will tend to be in an downward direction in a fall situation due to the vertical orientation of anchoring ring 4. This will result in the distribution of dynamic stresses and torque across the surface of the structure as opposed to being borne entirely by attachment means 2. That is, the surface area of base plate 3 provides a substantially increased distribution of dynamic forces resulting in less torque and strain being placed upon attachment means 2, thereby reducing the likelihood of failure of the attached means.

Figure 6:
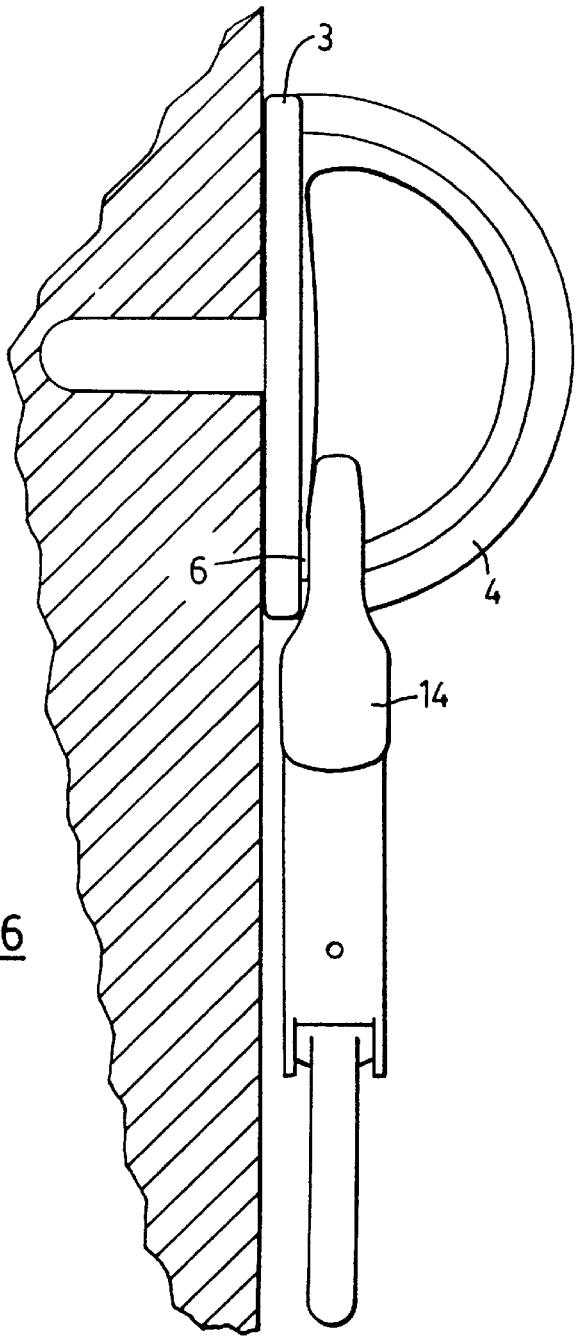

In the preferred embodiment attachment means 2, comprises at least one post 9 that is generally perpendicular to base plate 3 and extends outwardly therefrom. For ease of installation it is expected that in most instances post 9 will be a threaded stud which could be secured to the surface of a structure through the use of a nut or threaded bore (see FIG. 6). However, it will also be appreciated that other forms of attachment means aside from a threaded stud may be used. To further increase the amount of dynamic loading which connector 1 is able to withstand, a plurality of posts 9 could be situated on base plate 3. To ensure an acceptable working load capacity and safety factor the applicant has found that for a connector comprised of high strength alloy steel a base plate having a length of approximately 3½ inches provides for adequate distribution of dynamic loading forces across the surface of the structure. It will, however, be appreciated that for differing materials and loading requirements base plates of other lengths may be utilized.

It will also be noted in FIG. 4 that the width of anchoring ring 4 in plan view is not constant. At its upper and lower ends 5 and 6, anchoring ring 4 is wider than at its apex 10. Specifically, the width of anchoring ring 4 tapers from its widest point at ends 5 and 6 to its narrowest point adjacent apex 10. In the preferred embodiment only a relatively small segment of anchoring ring 4 on both sides of apex 10 is of constant width. This tapering of the width of anchoring ring 4 serves the purpose of encouraging and directing the movement of a hook latched around anchoring ring 4 towards apex 10 when ring 4 is horizontally oriented, or toward lower end 6 when anchoring ring 4 is vertically oriented. That is, in the preferred embodiment where connector 1 (and hence anchoring ring 4) is oriented in a generally vertical plane, a hook that is latched around anchoring ring 4 and that for some reason becomes positioned at upper end 5 will slide downwardly to lower end 6. The tapering of the width of anchoring ring 4 in the manner as described facilitates, encourages and directs the movement of the hook either downwardly toward lower end 6 or toward apex 10 depending upon the orientation of connector 1.

The directed movement of a hook that is attached around anchoring ring 4 in the manner described above is of significant importance. For example, in the situation where anchorage connector 1 is oriented horizontally, should a hook be allowed to settle into a stationary position that does not align generally with apex 10 (ie. if the hook is off-centre) the load applied to anchoring ring 4 by the hook will not be borne equally by both ends of base plate 3. In order to evenly distribute the load across the entirety of base plate 3 the hook is guided and directed toward the apex or middle of anchoring ring 4. Since in the preferred embodiment anchoring ring 4 contains a segment of constant width situated about apex 10, when anchoring ring 4 is oriented generally horizontally a hook that is received over ring 4 will be directed and held generally within this segment of constant width, thereby resulting in a more even loading of base plate 3.

Figure 2:
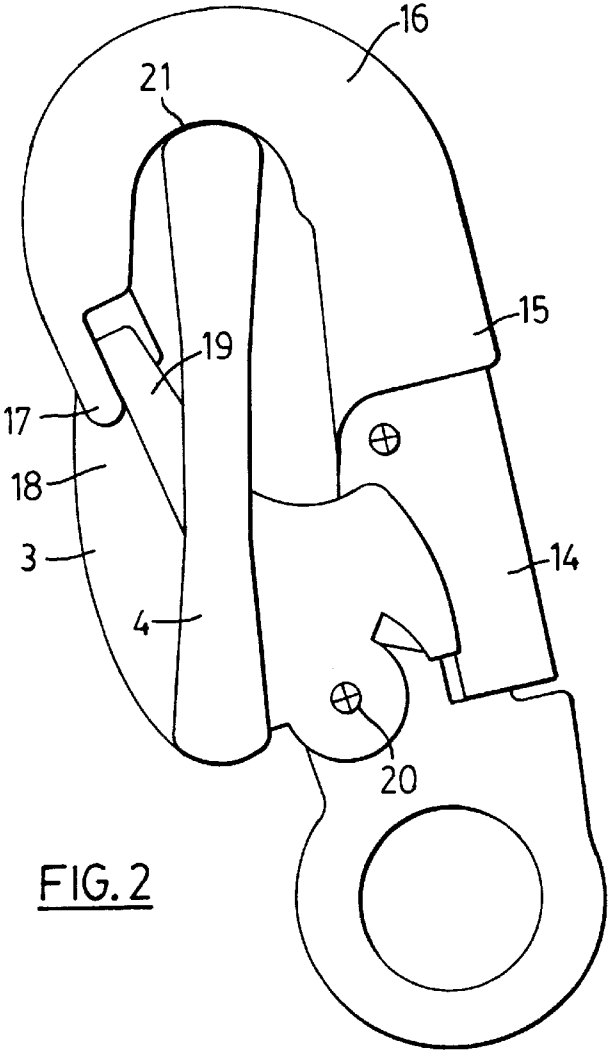
FIG. 2 is a plan view of the anchorage connector and locking snap hook of FIG. 1.

In the situation where anchorage connector 1 is oriented vertically, the tapering of the width of anchoring ring 4 assists in self correcting a hook that may be received around upper end 5. For example, in FIG. 2 a typical locking snap hook 14 is shown as being received around upper end 5 of anchoring ring 4. Snap hook 14 is comprised of a central shank 15 that ends in an arched shaped hook member 16 at one end. The free end 17 of hook member 16 defines a gateway opening 18 between hook member 16 and shank 15. A gate keeper 19 is mounted on shank 15 through a pivot point 20 and rotationally engages free end 17 to enclose the opening 18. As a result of the tapered width of anchoring ring 4 as described above, when snap hook 14 is received around upper end 5 of anchoring ring 4 as shown in FIG. 2, hook member 16 will be encouraged and directed downwardly along tapered ring 4 until it comes to rest at lower end 6 (see FIG. 6). In this manner a locking snap hook that is received around anchoring ring 4 is automatically self-corrected such that it comes to rest at lower end 6, regardless of its initial orientation about the ring.

In some cases the orientation of snap hook 14 may be such that gateway opening 18 effectively spans part of the circumference of anchoring ring 4 with gate keeper 19 resting against ring 4. This particular orientation has been found to be unsafe as it can result in the application of force against gate keeper 19 causing failure of the keeper and the possible dislodging of the hook. To help ensure that loading of gate keeper 19 is eliminated it has been discovered that the design of snap hook 14 should be such that the distance between the bowl 21 of hook member 16 and pivot point 20 is less than or equal to the distance between the outside diameter 22 of upper end 5 and the inside diameter 23 of lower end 6 of anchoring ring 4 (see FIG. 2). This structure will therefore effectively prevent snap hook 14 from become lodged in connector 1 such that gate keeper 19 is in a position that it can be subjected to loading. Regardless of the position of snap hook 14 all loading will be transferred to anchoring ring 4 through shank 15 and hook member 16, thereby preventing dynamic or other loading of gate keeper 19.

It will also be appreciated that, as shown in the attached drawings, in the preferred embodiment anchoring ring 4 forms an arch commencing at upper portion 7 of base plate 3 and ending at lower portion 8 of the base plate. The arch does not exceed 180 degrees and accordingly by the nature of its semi-circular geometry will tend to direct a hook latched around ring 4 downwardly toward lower end 6, when anchoring ring 4 is oriented in a generally vertical plane. Similarly, the geometry of the arch will direct a hook toward apex 10 when connector 1 is oriented horizontally.

Figure 5:
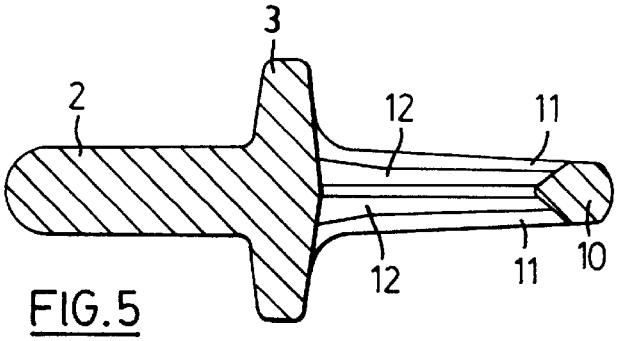
FIG. 5 is a sectional view of the anchorage connector of FIG. 3 taken along the line 5—5; and, FIG. 6 is a side view of the anchorage connector of the present invention with a locking snap hook positioned at its lower end.

In order to further assist in the encouragement and direction of a hook latched around anchoring ring 4 toward either apex 10 or lower end 6 (depending upon the orientation of ring 4) each side 11 of anchoring ring 4 has a chamfer 12 on its internal surface. As shown more clearly in FIGS. 3 and 5, chamfer 12 is preferably wider at upper and lower ends, 5 and 6 respectively, of anchoring ring 4 than at apex 10. Chamfer 12 generally functions in a similar fashion as the tapered width of anchoring ring 4 and compliments the encouraging and directing feature of that tapered width. To further facilitate in the sliding movement of a hook received around anchoring ring 4, sides 11 and chamfers 12 are preferably smooth and flat to minimize frictional drag.

Since the inherent strength and ability to withstand substantial dynamic loading is of critical importance to anchorage connector 1, it is preferably comprised of a high strength corrosion resistant material. In the preferred embodiment the connector is formed from #1541 steel that has been galvanized. However, it will be appreciated that other materials of similar strength could be also used. In addition, webs 13 are formed between base plate 3 and upper and lower ends 5 and 6 of anchoring ring 4 to strengthen the connection between anchoring ring 4 and base plate 3, and to increase the overall load capacity of connector 1.

It is to be understood that what has been described are the preferred embodiments of the invention and that it is possible to make variations to these embodiments while staying within the broad scope of the invention. Some of these variations have been discussed while others will be readily apparent to those skilled in the art.

We claim:

1. An anchorage connector comprising:

(i) attachment means to secure said connector to a surface of an object;

(ii) a base plate connected to said attachment means, said base plate providing a means to distribute forces to which said connector is subjected across the surface of the object when said connector is secured to the object by said attachment means; and, (iii) a generally arched shaped anchoring ring having its upper end attached to the upper portion of said base plate and its lower end attached to the lower portion of said base plate such that said anchoring ring is positioned approximately perpendicular to said base plate, the width of said anchoring ring when viewed in a plane parallel to said base plate being greater at its upper and lower ends than at its apex such that said width of said ring is tapered towards said apex, each side of said anchoring ring having a chamfer on its inner edge, said chamfer being wider at said upper and lower ends of said anchoring ring than at said apex, said tapered width of said anchoring ring and said chamfer assisting in the encouragement and direction of a hook latched around said anchoring ring towards said apex when said anchoring ring is horizontally oriented, or towards said lower end of said anchoring ring when said anchoring ring is vertically oriented.

2. A connector as claimed in claim 1 wherein said attachment means comprises at least one post generally perpendicular to said base plate and extending outwardly therefrom.

3. A connector as claimed in claim 2 wherein said anchoring ring contains a segment of constant width about said apex such that a hook latched around said anchoring ring will tend to remain engaged about said segment of constant width when said anchoring ring is generally horizontally oriented thereby assisting in the even distribution the load of said hook across both ends of said anchoring ring and across said base plate.

4. A connector as claimed in claim 3 wherein said post is a threaded stud.

5. A connector as claimed in claim 4 having web members situated between said upper and said lower ends of said anchoring ring and said base plate.

6. A connector as claimed in claim 5 wherein the sides of said anchoring ring are generally smooth and flat to facilitate the sliding of a hook thereon.

7. A connector as claim in claim 6 wherein said internal chamfers are generally smooth and flat.

8. A connector as claimed in claim 1 in combination with a locking snap hook, said snap hook comprising: a central shank ending in an arched shaped hook member that has a free end defining a gateway opening between said hook member and said shank; and, a gate keeper rotationally mounted on said shank at a pivot point and pivotally engaging said free end of said arched shaped hook member to enclose said gateway opening, such that when said locking snap hook is received around said anchoring ring the loading of said snap hook results in a transference of said load to said anchoring ring through said shank and said hook member only without subjecting said gate keeper to dynamic or other loading forces.

9. A connector as claimed in claim 8 wherein the distance between a bowl of said arch shaped hook member and said pivot point on said locking snap hook is less than or equal to the distance between the outside diameter of said upper end of said arched shaped anchoring ring and the inside diameter of said lower end of said anchoring ring of said anchorage connector thereby preventing dynamic or other loading of said gate keeper.

* * * * *